US006123563A

United States Patent [19]

Johnson et al.

[11] Patent Number: 6,123,563

[45] Date of Patent: Sep. 26, 2000

[54] ANTI-DECOUPLING ARRANGEMENT FOR AN ELECTRICAL CONNECTOR

[75] Inventors: Heath Allen Johnson, Bainbridge; Clifford Joseph Westrick, Oneonta; David Leigh Frear, Bainbridge, all of N.Y.

[73] Assignee: Amphenol Corporation, Wallingford, Conn.

[21] Appl. No.: 09/391,458

[22] Filed: Sep. 8, 1999

[51] Int. Cl.[7] ..... H01R 13/623

[52] U.S. Cl. ..... 439/321

[58] Field of Search ..... 439/321, 320, 439/312, 470, 313, 318

[56] References Cited

U.S. PATENT DOCUMENTS

| | | | |
|---|---|---|---|
| 4,109,990 | 8/1978 | Waldron et al. | 439/321 |
| 4,479,689 | 10/1984 | Marmillion et al. | 439/312 |
| 4,484,790 | 11/1984 | Schildkraut et al. | 439/312 |
| 4,487,470 | 12/1984 | Knapp et al. | 439/312 |
| 4,519,661 | 5/1985 | Brush, Sr. et al. | 439/312 |
| 4,536,048 | 8/1985 | Schildkraut et al. | 439/312 |
| 4,588,246 | 5/1986 | Schildkraut et al. | 439/312 |
| 4,641,811 | 2/1987 | Gallusser et al. | 249/122 |
| 4,726,782 | 2/1988 | Hager et al. | 439/321 |
| 4,746,303 | 5/1988 | Cobraiville et al. | 439/321 |
| 4,808,123 | 2/1989 | Dee et al. | 439/470 |
| 4,984,995 | 1/1991 | Tucker et al. | 439/321 |
| 5,082,454 | 1/1992 | Tonkiss et al. | 439/320 |
| 5,145,394 | 9/1992 | Hager | 439/321 |
| 5,199,894 | 4/1993 | Kalny et al. | 439/321 |
| 5,653,605 | 8/1997 | Woehl et al. | 439/321 |
| 5,681,177 | 10/1997 | Mikolaicyk et al. | 439/321 |
| 5,702,263 | 12/1997 | Baumann et al. | 439/321 |
| 5,785,545 | 7/1998 | Holt | 439/352 |
| 5,957,716 | 9/1999 | Buckley et al. | 439/321 |

*Primary Examiner*—Khiem Nguyen
*Assistant Examiner*—Son V. Nguyen
*Attorney, Agent, or Firm*—Blank Rome Comisky & McCauley, LLP

[57] ABSTRACT

An anti-decoupling arrangement for an electrical connector includes a spiral lock clutch, a spring ring, and a separate ratchet wheel or tooth ring having a plurality of radial cuts, all surrounding the connector shell and sandwiched between a flange or shoulder on the connector shell by a conventional snap ring. The tooth ring is situated in a space between the thread of the coupling nut and the flange or shoulder that forms the inner surface of a recessed area with the coupling nut. The shell includes two grooves, one for the spiral lock clutch and the other for the snap ring, that are behind the flange or shoulder towards the rear of the connector, the shell providing axial alignment of all components except the spring ring. The tooth ring also includes extensions that cooperate with a notch or slot in the coupling nut so that the tooth ring rotates with the coupling nut, while the spring ring includes an extension in engagement with a notch in the spiral lock clutch so that the spring ring is locked against angular rotation relative to a spring ring. Preferably, the spring ring member is a self supporting ring that has spring tines or beams of a given number located angularly around its radial wall. These tines provide the ratchet mechanism when the tines glide over the radial cuts of the tooth ring in the uncoupling direction. This provides a free running clutch in the coupling direction and a torque/ratchet mechanism in the uncoupling direction. Alternatively, the decoupling assembly may be flipped by 180 degrees, the tooth ring being replaced by teeth extending axially from an inwardly extending flange in the coup ling nut.

28 Claims, 7 Drawing Sheets

ANTI-DECOUPLING ARRANGEMENT FOR AN ELECTRICAL CONNECTOR

BACKGROUND OF THE INVENTION

1. Field of the Invention

The present invention generally relates to anti-decoupling arrangements for connectors of the type in which coupling is achieved by means of a coupling nut, and more particularly to an anti-decoupling arrangement for an electrical connector that uses a ratchet mechanism to limit rotation of the coupling nut in the decoupling direction and a spiral lock clutch to permit free rotation of the coupling nut in the coupling direction. Still more particularly, the invention relates to improvements on the anti-decoupling arrangement disclosed in commonly assigned U.S. Pat. No. 4,536,048.

2. Description of the Related Art

A typical connector to which the present invention may be applied includes a connector shell containing electrical contacts and an internally threaded coupling nut rotatably mounted on the connector shell. The connector shell is coupled to a corresponding externally threaded mating connector by means of the coupling nut in such a manner that electrical contacts in the mating connector engage the electrical contacts in the connector shell. The coupling nut is held on the connector shell by one or more snap rings and/or spring washers that are designed to captivate or press a radial flange of the coupling nut against a corresponding flange or shoulder on the connector shell.

Because the frictional anti-locking force generated by engagement between the coupling nut and connector shell in such an arrangement is insufficient to prevent the coupling nut from rotating in a decoupling direction as a result of vibrations or shocks, compromising seals and possibly affecting the integrity of the electrical connections between contacts, it is conventional to include an additional anti-decoupling mechanism in connectors likely to be used in environments where vibrations or shocks are likely to occur, such as in military high-performance aircraft and other vehicles. The simplest and most common method of preventing unintended decoupling as a result of shocks or vibrations has been to include in the connector a metal ratchet spring having protrusions or dimples at the center of the beam the ratchet spring being permanently attached to the inside diameter of the threaded coupling nut. The connector shell is provided with ratchet teeth on its outer diameter, which are engaged by the ratchet spring.

One problem with this type of coupling is that the discrete detent positions do not necessarily lie in phase with the fully clamped position of the ring, such that even slight vibrations can cause the ring to back off slightly, which can cause sealing problems. In addition, the detent members in this configuration have very little effective surface area, causing rapid wearing away of the teeth on the ratchet wheel each time the connector is mated or unmated.

A solution to the problems of wear and phasing of the ratchet teeth and detents is proposed in commonly assigned U.S. Pat. No. 4,536,048. As illustrated in FIG. 1, appended hereto, the anti-decoupling arrangement disclosed in this patent utilizes a spiral lock clutch 1 having a single axially extending spring tine 2 arranged to engage a ratchet wheel 3 positioned at the rear of the coupling nut 4, the coupling nut being captured between the spiral lock clutch 1 and a flange or shoulder 5 on a plug connector shell 6 and arranged to be threaded onto an externally threaded mating receptacle 7. The spiral lock clutch is arranged to unwind in response to turning of the nut in a coupling direction, thereby permitting the clutch to move freely in response to tightening of the nut so as to minimize the locking torque and consequently wear on the anti-decoupling mechanism. On the other hand, application of a torque to the ratchet in the opposite or uncoupling direction causes the clutch to engage the shell and lock the spring tine 2 relative to the plug connector shell 6, preventing rotation and therefore accidental loosening. When a higher torque is applied, the spring tine is able to ratchet over the teeth, thereby permitting rotation of the coupling nut in the decoupling direction.

While the use of a single beam and an integral ratchet wheel provides advantages with respect to wear and ease of operation, the single detent is subject to failure at a relatively low torque and, in addition, the integral coupling nut and ratchet wheel is difficult to manufacture.

The present invention, on the other hand, offers various improvements to the decoupling mechanism described in U.S. Pat. No. 4,536,048, including a higher and more easily adjusted decoupling torque, and greater reliability than can be provided by the single detent inherent in the use of the lateral detent and spring lock clutch design disclosed in U.S. Pat. No. 4,536,048.

SUMMARY OF THE INVENTION

It is accordingly a first objective of the invention to provide an electrical connector anti-decoupling mechanism of the same general type as the mechanism disclosed in U.S. Pat. No. 4,536,048, including a spiral lock clutch that permits free running in the coupling directions and a spring ring and tooth wheel arrangement that ratchets in response to a decoupling torque, and yet that provides multiple points of engagement between the spring clutch mechanism and the ratchet wheel in order to increase the decoupling torque and reduce wear.

It is a second objective of the invention to provide a low coupling force, high decoupling force connector anti-decoupling assembly that utilizes a spiral spring clutch and ratchet mechanism of the same general type as the mechanism described in U.S. Pat. No. 4,536,048, but in which the spiral spring clutch is not required to provide a ratchet function or to hold the coupling nut on the connector, and that is relatively easy to assemble in comparison with conventional anti-decoupling mechanisms, with low cost component manufacturability.

It is a third objective of the invention to provide an electrical connector anti-decoupling mechanism of the same general type as the mechanism disclosed in U.S. Pat. No. 4,536,048, in which the uncoupling force can be adjusted without component interchange.

It is a fourth objective of the invention to provide a low coupling force, high decoupling force connector anti-decoupling arrangement which can be easily assembled, and in which parts of the assembly are all relatively simple to manufacture.

These objectives of the invention are achieved, according to the principles of a preferred embodiment of the invention, by providing an anti-decoupling arrangement for an electrical connector (as well as an electrical connector incorporating such an anti-decoupling arrangement) which includes, in addition to a spiral lock clutch, a spring ring, and a separate ratchet wheel or tooth ring having a plurality of radial cuts, all surrounding the connector shell and sandwiched between a flange or shoulder on the connector shell by a conventional snap ring. The tooth ring is advantageously situated in the space between the thread of the coupling nut and the flange or shoulder that forms the inner surface of a recessed area with the coupling nut, while the shell preferably includes at least one groove for the snap ring and, in the illustrated embodiment, an optional second groove for the spiral lock clutch. The groove for the snap ring and the optional groove for the spiral lock clutch are situated behind the flange or shoulder towards the rear of the connector, the shell providing axial alignment of all components except the spring ring.

The tooth ring may include extensions that cooperate with a notch or slot in the coupling nut, a plurality of knurls or protrusions on the outside diameter of the tooth ring which engage and deform into an internal diameter of the coupling nut, or other means for locking the tooth ring against angular rotation relative to the coupling nut, while the spring ring preferably include an extension in engagement with a notch in the spiral lock clutch so that the spring ring is locked against angular rotation relative to a spring ring. Preferably, the spring ring member is a self supporting ring that has spring tines of a given number located angularly around its radial wall. These tines provide the ratchet mechanism when they glide over the radial cuts of the tooth ring in the uncoupling direction. This provides a free running clutch in the coupling direction and a torque/ratchet mechanism in the uncoupling direction.

More specifically, when the coupling nut and tooth ring are turned in a coupling or mating direction, the teeth on the tooth ring engage the spring tines and cause the spring ring to also turn in the coupling direction, which causes the spiral lock clutch to turn in the coupling direction. Turning of the spiral lock clutch in the coupling direction causes it to unwind from the connector shell and freely rotate, thus permitting coupling to occur without any resistance from the anti-decoupling mechanism.

On the other hand, when the coupling nut is rotated in an unmating or decoupling direction, the spring tines are pushed by the tooth ring to rotate in the uncoupling direction, causing the spiral lock clutch to tighten and prevent further rotation of the spring ring, the tines of which are then ratcheted over the teeth of the tooth ring to provide resistance to uncoupling.

By appropriate selection of the number of turns or wraps of the spiral lock clutch, and therefore the point where it locks, as well as the shape of the teeth and the construction of the spring tines, the size and amount of torque the connector must withstand before it begins to ratchet can easily be controlled.

Furthermore, although the provision of the teeth on a separate tooth ring is preferred for reasons of manufacturability, it may be possible in a variation of the preferred embodiment to essentially flip the preferred anti-decoupling mechanism by 180 degrees, reversing the order of the elements and in particular forming the teeth so that they extend axially from the inwardly extending flange in the coupling nut.

The structure of the preferred embodiment of the invention, as well of variations thereof, share with the arrangement of U.S. Pat. No. 4,536,048 at least the following advantages:

(i) The required coupling force is substantially reduced due to the expansion of the spiral lock clutch, which allows it and the spring ring to rotate smoothly around the plug shell circumference with minimum resistance.

(ii) Wear on the ratchet mechanism is greatly reduced because the ratchet mechanism operates only during decoupling, rather than during both coupling and decoupling as in other types of anti-decoupling mechanisms, (iii) Should the snap ring fail to contain the mechanism, the plug connector shell will still be axially retained in the receptacle by engagement between the coupling nut and the receptacle, which is not the case in arrangements where the front of the coupling is held only by the anti-decoupling mechanism and the plug connector can therefore pull away from the nut upon failure of the anti-decoupling mechanism, and results at least in the following improvements:

(iv) A high uncoupling torque is attained through the use of a multiple beam spring ring attached to the spiral lock clutch.

(v) The high uncoupling torque can be easily adjusted to meet the requirements of different applications without any additional components, by appropriate choice of the spiral lock clutch, spring tines, and tooth configuration.

(vi) The mechanism can be assembled by simply fitting all of the components over the plug shell, angularly orienting the clutch and spring ring and the tooth ring and nut, and holding them in place with a snap ring.

DETAILED DESCRIPTION OF THE PREFERRED EMBODIMENTS

Figure 3:
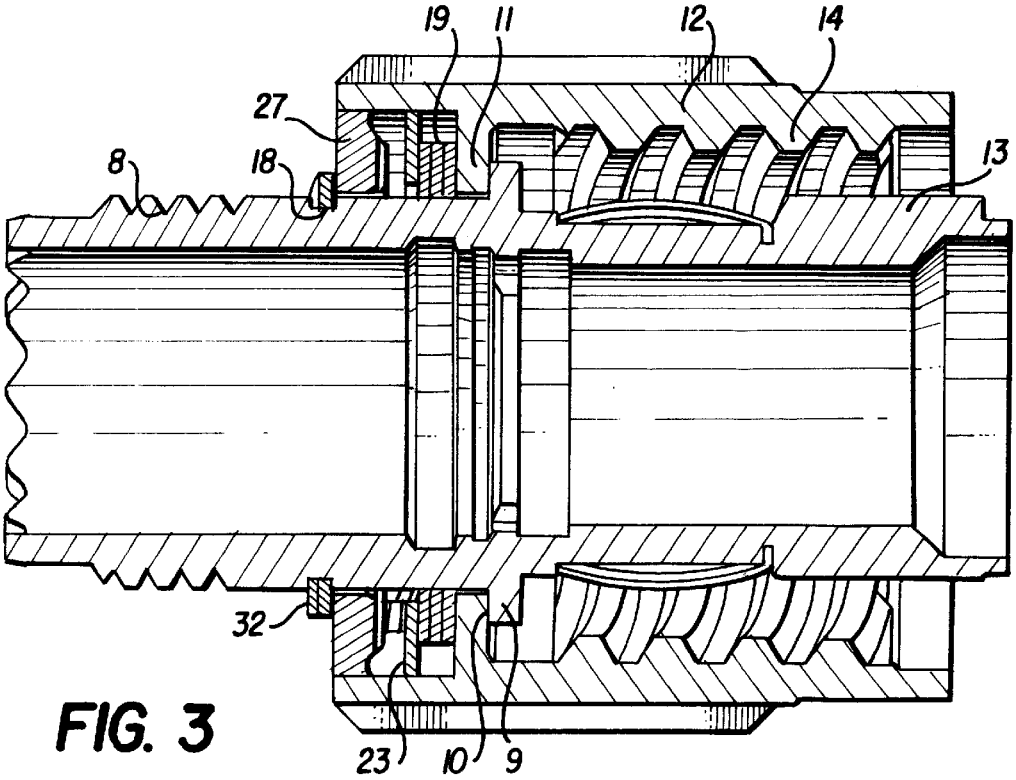
FIG. 3 is a cross-sectional side view of the electrical connector and antidecoupling arrangement of FIG. 2.
Figure 2:
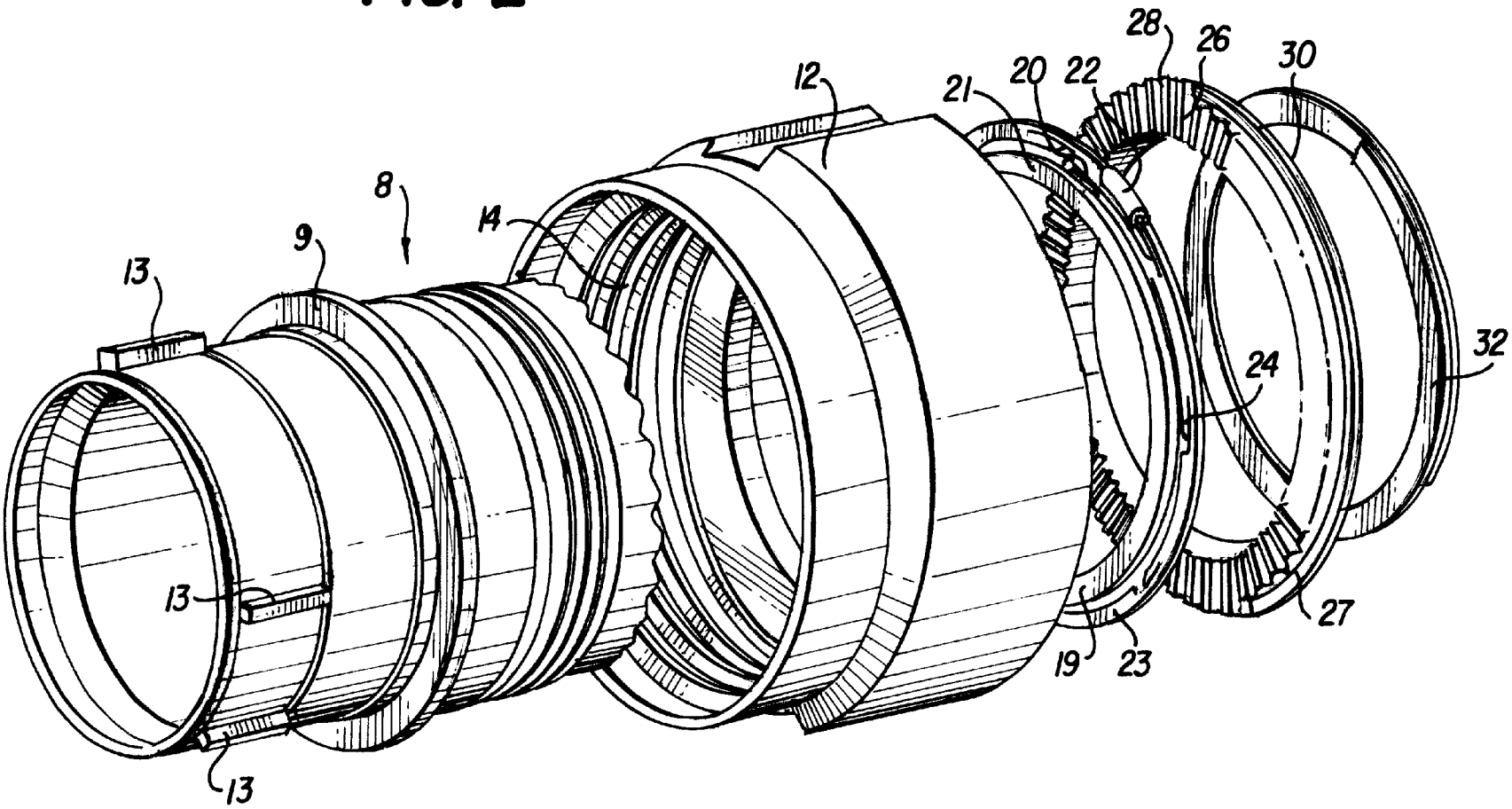
FIG. 2 is an isometric view showing an electrical connector anti-decoupling arrangement constructed in accordance with the principles of a preferred embodiment of the invention.

As illustrated in FIGS. 2 and 3, a connector having a anti-decoupling mechanism constructed in accordance with the principles of a preferred embodiment of the invention includes a plug connector shell 8 having a front mating section corresponding to the one illustrated in U.S. Pat. No. 4,536,048, incorporated herein by reference. Between the front and rear section of the plug connector shell 8 is a flange or shoulder 9 having a rear surface 10 which faces a collar or flange 11 extending radially inwardly from the coupling nut 12.

The illustrated connector shell 8 and coupling nut 12 have the general configuration of a type of connector known as the "Series III" connector, including such features as polarizing keys 13, and a standard Tri-start thread 14 on the coupling nut 12. However, although the anti-decoupling arrangement of the preferred embodiment is especially suitable for use in the Series III connector, which is designed to be used in harsh environments (the standards therefor being specified in standard shell sizes 9–25 according to MIL-C-38999/26D, dated May 7, 1990), those skilled in the art will appreciate that the principles of the invention are not limited to Series III connectors, but rather are applicable to any cylindrical connectors having threaded couplings and a need for an anti-decoupling arrangement.

To the rear of the flange 9 of connector shell 8 and collar 11 of coupling nut 12 is a spiral lock clutch 19. Spiral lock clutch 19 is preferably in the form of a wound radial spring band surrounding the shell 13 or, optionally, interference fit into a groove (not shown) in the shell, and includes a notch 20 at a rearward side near an end 21 of the clutch. Notch 20 is arranged to receive a rearwardly extending protrusion 22 of a spring ring 23 such that when the spring ring 23 is fitted onto the plug connector shell and oriented so that protrusion 22 aligns with notch 20, spring ring 23 and end 21 are thereby locked against relative movement. Except for the notch 20 and the absence of a ratchet element, spiral lock clutch 19 may be similar to the spiral ring disclosed in U.S. Pat. No. 4,536,048.

Figure 6:
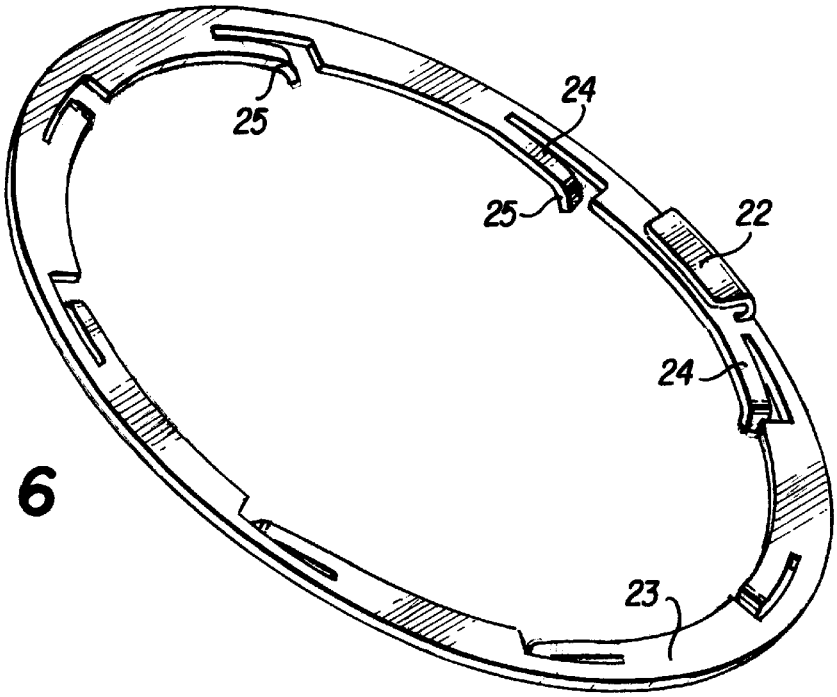
FIG. 6 is an isometric view showing a spring ring for use in the anti-decoupling arrangement of the preferred embodiment.
Figure 5:
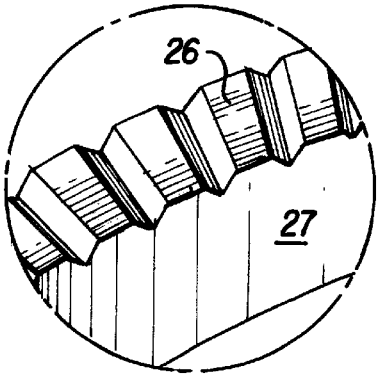
FIG. 5 is an enlarged isometric view of a portion of the tooth ring illustrated in FIG. 4.
Figure 8:
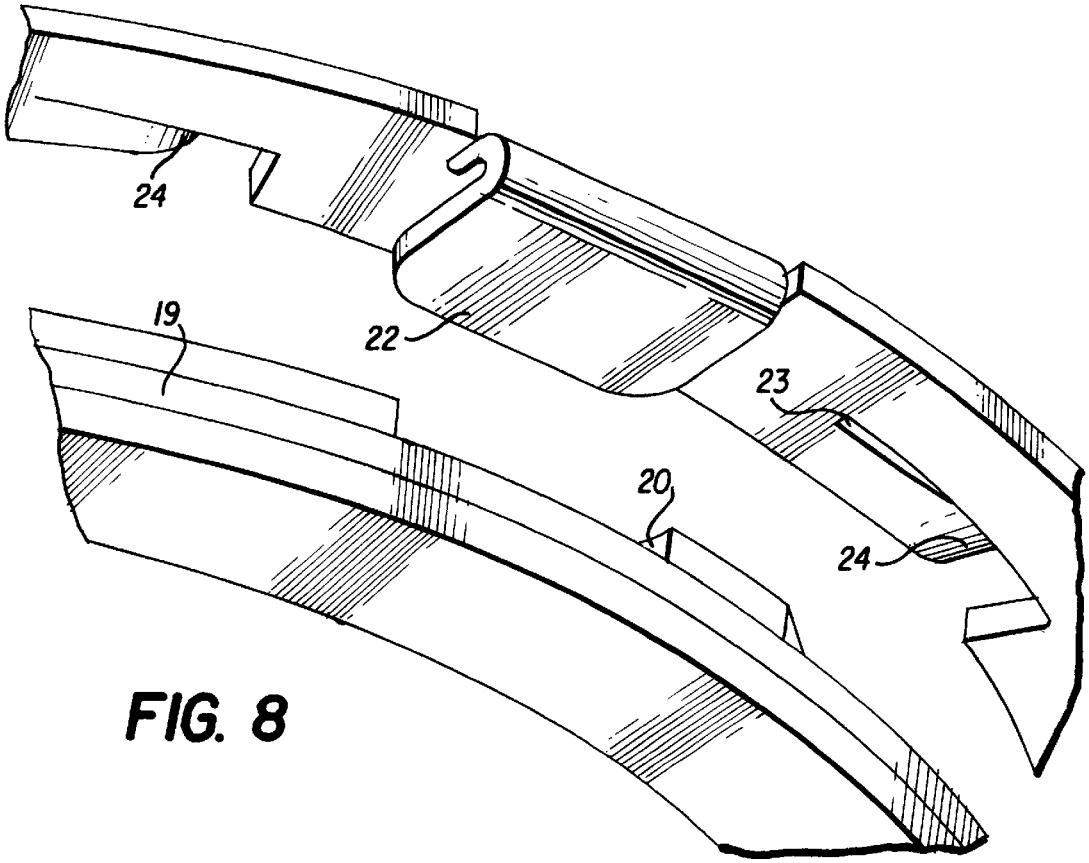
FIG. 8 is an isometric view showing details of the engagement between the spring ring and spiral lock clutch of the preferred embodiment.
Figure 9:
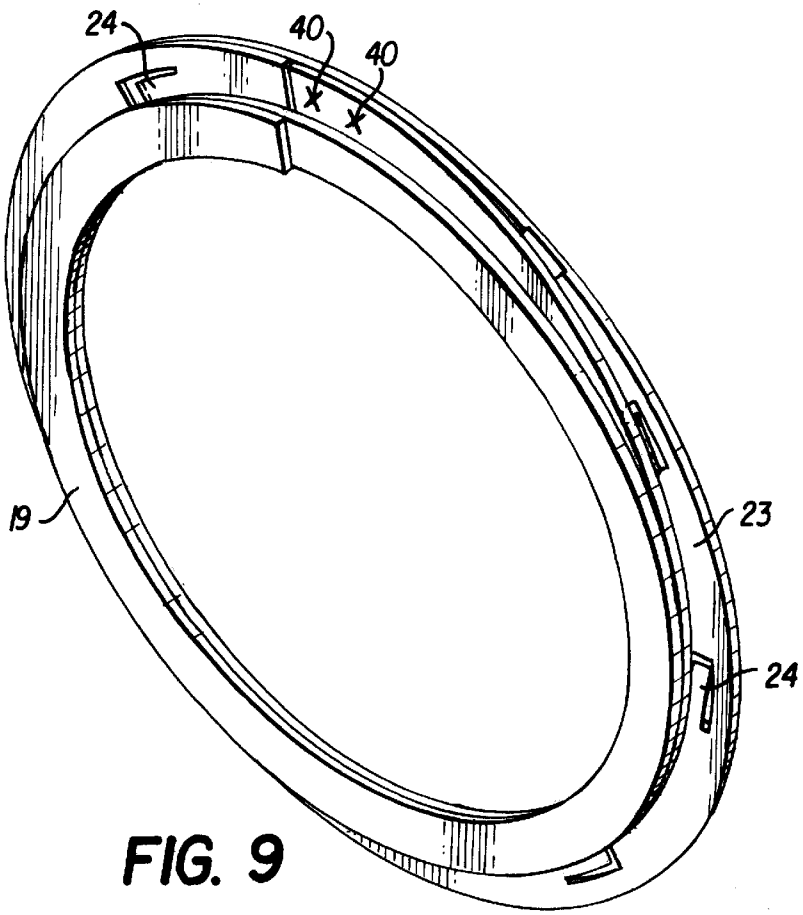
FIG. 9 is an isometric view of a variation of the spring ring/clutch engaging arrangement illustrated in FIG. 8.

Details of the protrusion 22 are illustrated in FIGS. 6 and 8. Although illustrated as a tab bent backwards over the spring ring 23, those skilled in the art will appreciate that protrusion 22 may take a variety of forms so long as it is capable of cooperating with corresponding structures on clutch 19 to lock clutch 19 against rotation relative to spring ring 23. In addition, it will be appreciated by those skilled in the art that, instead of a protrusion 22 and notch 20 at the rearward side of the spiral lock clutch 19 and protrusion 22 on spring ring 23, the spiral lock clutch 19 and protrusion 22 may be locked together against rotation by a weld joint 40, as illustrated in FIG. 9, or by any other suitable joining structure.

Figure 4:
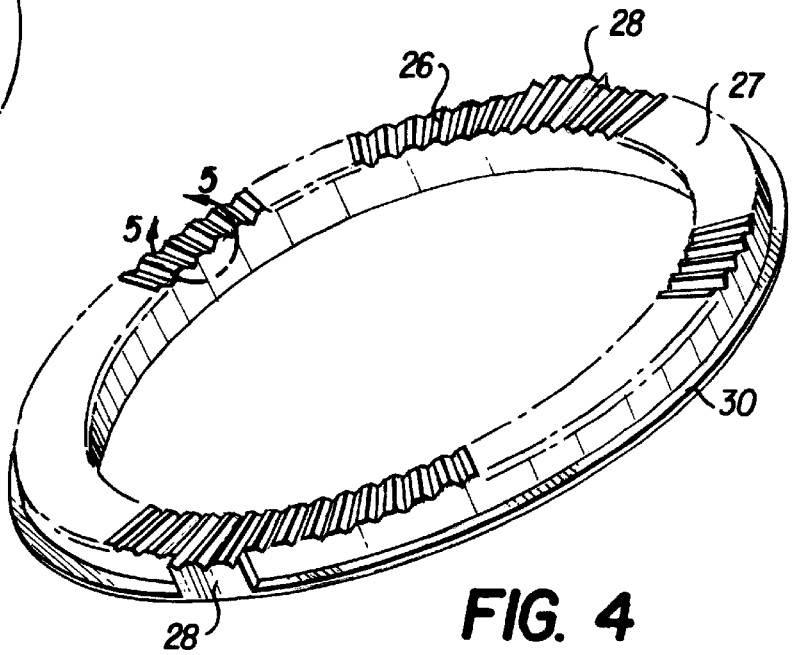
FIG. 4 is an isometric view showing details of a tooth ring for use in the anti-decoupling arrangement of the preferred embodiment.
Figure 7:
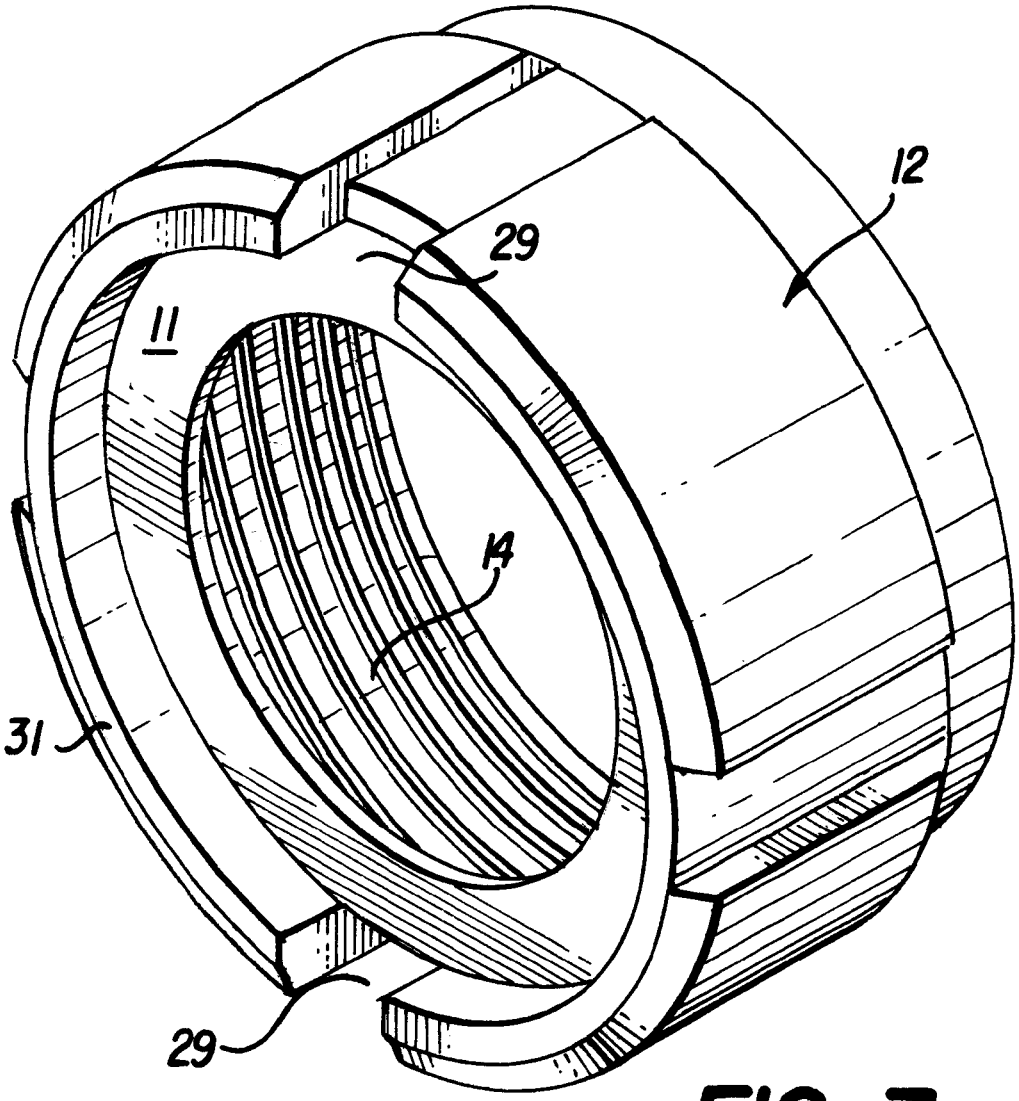
FIG. 7 is an isometric view showing a rear and side of a coupling nut for use in the anti-decoupling arrangement of the preferred embodiment.

Spring ring 23 includes, in addition to rearwardly facing protrusion 22, a plurality of forwardly extending spring tines or beams 24, as shown in FIG. 4. Spring beams 24 preferably include angled sections 25 arranged to cooperate with corresponding teeth 26 on tooth ring 27 to provide a ratcheting effect, as described below, when tooth ring 27 is fitted over the plug connector shell, with the toothed front surface of the tooth ring facing the rear surface of the spring ring.

Tooth ring 27 includes at least one tab or projection 28 engageable with a slot or notch 29 at the rear of the coupling nut to lock tooth ring 27 against rotation relative to the coupling nut 16, so that the toothed ring turns with the coupling nut. A flange 30 extends from the tooth ring and engages the rear surface 31 of the coupling nut to retain the coupling nut upon securing the tooth ring 27 in place using snap ring 32, which is retained by a groove 18 in the rear section of the plug connector shell. Teeth 26 are formed by radial cuts and preferably have angled edges that permit ratcheting with an appropriate torque during decoupling. The angle of the sides against which the beams 24 are pressed during decoupling is not critical due to the nominal torque resulting from release of the clutch during coupling.

Figure 1:
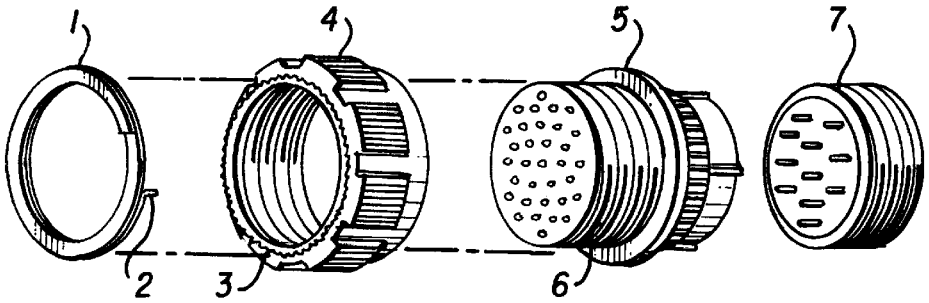
FIG. 1 (PRIOR ART)
FIG. 1 is an isometric view showing a prior art anti-decoupling arrangement.
Figure 10:
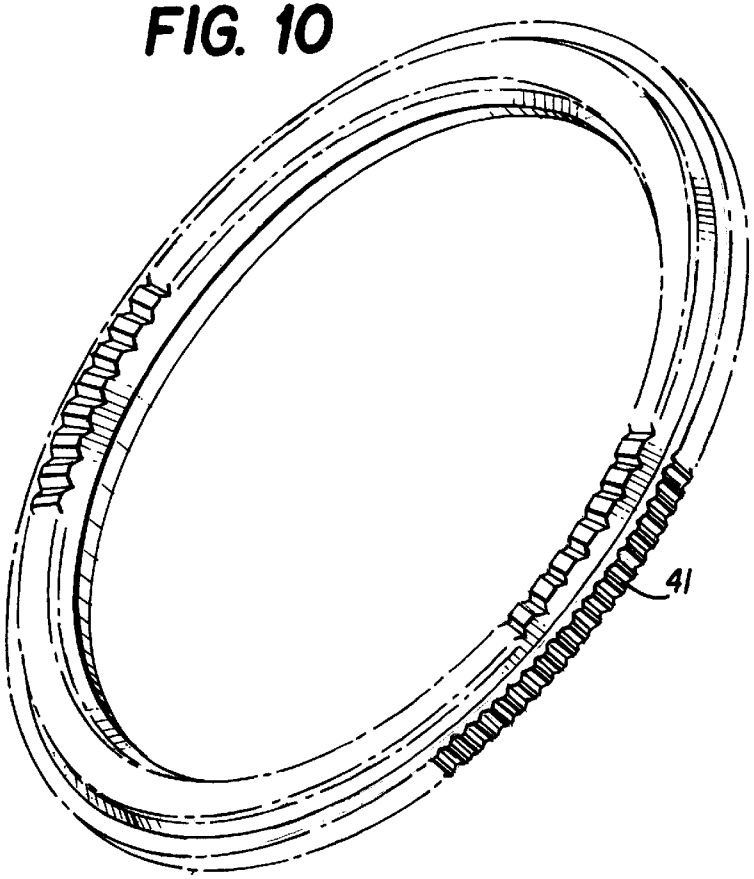
FIG. 10 is an isometric view of a variation of the tooth ring of the preferred embodiment.
Figure 11:
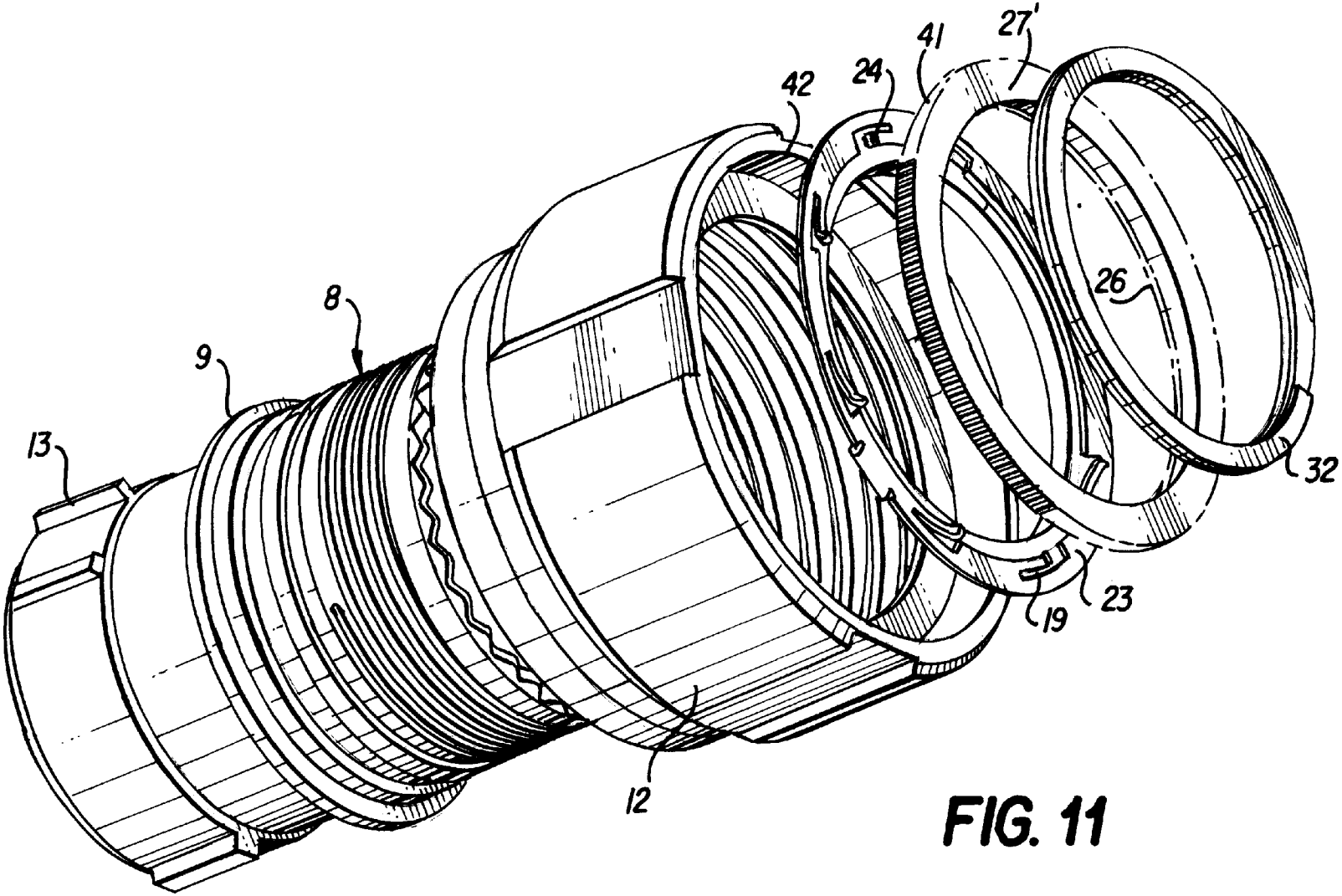
FIG. 11 is an isometric view of a connector utilizing the variation of the tooth ring illustrated in FIG. 10.

It will of course be appreciated by those skilled in the art that the manner in which the tooth ring is locked against rotation relatively to the coupling nut is not limited to the protrusion and notch illustrated in FIGS. 1 and 2. For example, as shown in FIGS. 10 and 11, the tooth ring may be modified to form a tooth ring 27' that includes a plurality of knurls or protrusions 41 on the outside diameter of the tooth ring which engage and deform, i.e., are press-fit, into an internal diameter 42 of the coupling nut 12, in which case the flange 30 would be omitted from the tooth ring.

The anti-decoupling mechanism of the preferred embodiments illustrated in FIGS. 1–11 is assembled to the connector, as follows:

(i) The coupling nut is assembled onto the shell such that inwardly extending flange 11 engages outwardly extending flange or shoulder 9.

(ii) The spiral lock clutch is then assembled onto the shell such that it resides immediately to the rear of flange 9.

(iii) The spring ring 23 is then assembled onto the spiral lock clutch 19 so that it is held angularly by the protrusion 22 extending from the opposite side of the spring ring 23 from the cantilever beams.

(iv) Next, the tooth ring 27 is assembled onto the coupling nut 12 and angularly fixed thereto by engagement between the projection or tab 28 and the slot or notch 29 in the coupling nut 12 or by engagement between protrusions 41 and inside diameter 42 of the coupling nut.

(v) Finally, a snap ring 32 is fitted into the second groove 18 to entrap the entire anti-decoupling assembly.

The connector thus assembled operates as follows: When the coupling nut 12 is rotated in the mating or coupling direction, tooth ring 27 also rotates in the coupling direction, causing teeth 26 to exert a torque on cantilever beams 24, rotating the spring ring 23, which in turn rotates the spiral lock clutch 19 in a direction which causes the clutch to unwind from the plug connector shell 8 and freely rotate relative thereto. As a result, the coupling nut can be rotated with a light torque to secure the coupling nut 12 to a mating connector.

When a torque is applied to the coupling nut in the decoupling direction, the cantilever beams of the spring ring pull towards the shallow angle of the cuts in the tooth ring, causing the spring ring to attempt to rotate the spiral lock clutch in the decoupling direction. This decoupling torque locks the clutch and the spring to the plug connector shell. When the decoupling torque applied to the coupling nut exceeds a threshold (preferably above the value of any vibration or shock induced torques to which the connector is subject), since the spring ring 23 is locked against rotation by the spiral lock clutch 19, the tooth ring is forced to ratchet over the cantilever beams 24 of the spring ring 23, thereby permitting the coupling nut 12 to be decoupled from the corresponding externally threaded portion of the mating connector.

Figure 12:
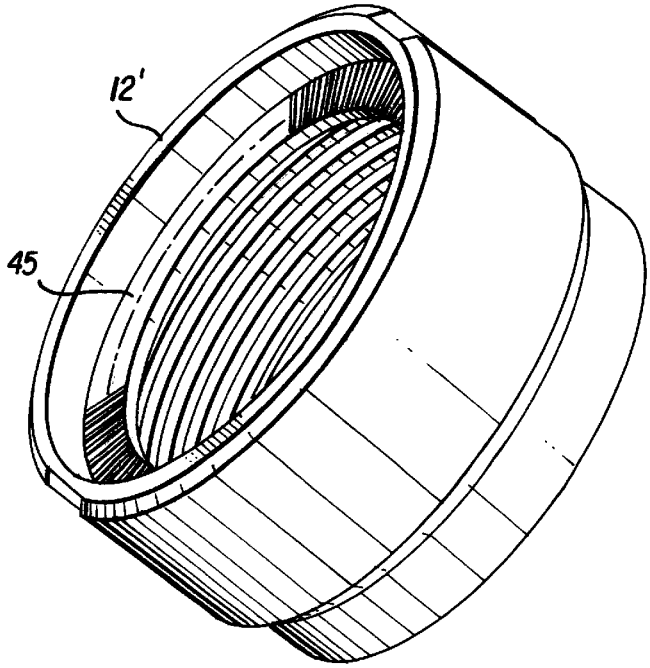
FIG. 12 is an isometric view of a variation of the anti-decoupling arrangements of FIGS. 1–11, in which the tooth ring is integrated with the coupling nut.

In a variation of the anti-decoupling arrangement illustrated in FIGS. 1–11, it is possible that the entire design may be flipped 180 degrees so that the teeth extending in the embodiment of FIGS. 1–11 from the tooth ring 27 (or 27') are instead placed on the inwardly extending flange or shoulder 45 of the coupling nut 12', as illustrated in FIG. 12, and the current tooth ring becomes a washer to just captivate the assembly. In this variation of the preferred embodiment, the spiral lock clutch and spring ring would serve the same purposes as in the illustrated embodiment, distinguishing the resulting decoupling mechanism from that of U.S. Pat. No.

4,536,048, although this variation of the preferred embodiment shares some of the manufacturing difficulties of the design shown in U.S. Pat. No. 4,536,048.

Having thus described a preferred embodiment of the invention and variations of the preferred embodiment in sufficient detail to enable those skilled in the art to make and use the invention, it will nevertheless be appreciated by those skilled in the art that the illustrated connector and decoupling arrangement may be further varied or modified by those skilled in the art. For example, the type of connector to which the decoupling arrangement of the preferred embodiment is applied may be freely modified, as may such details as the nature of the complementary interengaging surfaces between the coupling nut and the plug connector shell (i.e., flanges 9 and 11) or the structures that lock the spring ring 23/spiral lock clutch 19 and tooth ring 27/coupling nut 12 against mutual angular movement.

Each of these variations and modifications, including those not specifically mentioned herein, is intended to be included within the scope of the invention, and thus the description of the invention and the illustrations thereof are not to be taken as limiting, but rather it is intended that the invention should be defined solely by the appended claims.

What is claimed is:

1. An anti-decoupling arrangement arranged to be fitted on a connector shell having a front mating end and a coupling nut fitted over the connector shell, said anti-decoupling arrangementpreventing rotation of the coupling nut in a decoupling direction, comprising:

a spiral lock clutch extending around said connector shell;

a spring ring positioned to the rear of the spiral lock clutch, front and rear being hereinafter taken relative to an axis of the connector shell and its front mating, said spring ring also extending around said connector shell, said spring ring and spiral lock clutch being locked together against relative movement so that the spiral lock clutch rotates with the spring ring, and said spring ring further including beams extending obliquely in a rearwards direction;

a tooth ring positioned to the rear of the spring ring and also extending around said connector shell, said tooth ring being locked against angular movement relative to the coupling nut such that the tooth ring rotates together with the coupling nut, said tooth ring including a plurality of radial cuts that form teeth having first and second sides, said beams being pressed against first sides of said teeth during coupling and second sides of the teeth during decoupling; and a retention member positioned to the rear of the tooth ring in a second groove in the connector shell to capture the tooth ring, spring ring, spiral lock clutch, and coupling nut and retain them on the connector shell, wherein when said coupling nut is rotated in a coupling direction, a tooth wheel rotates in a coupling direction, said engagement of said beam with said teeth causes rotation of the spring ring in the coupling direction together with the rotation of the tooth wheel, which causes rotation of the spiral lock clutch in the coupling direction together with the spring ring, said spiral lock clutch being arranged to release a first groove and freely rotate relative to the connector shell to thereby provide minimal resistance to coupling, wherein when a torque less than a threshold value is applied to said coupling nut in a decoupling direction, a corresponding torque is applied to said tooth wheel in the decoupling direction, said engagement of the teeth with the beams further causing a torque to be applied to the spring ring in the decoupling direction, and said torque applied to the spring ring in the decoupling direction causing said spring lock clutch to lock and prevent rotation of the spring ring in the decoupling direction, and wherein when a torque greater than a threshold value is applied to the coupling nut in the decoupling direction, said greater torque causes said beams to ratchet over the teeth to permit the coupling nut to be rotated in the decoupling direction despite continued locking of the spiral lock clutch and spring ring against rotation.

2. An arrangement as claimed in claim 1, wherein said spiral lock clutch is a wound radial spring band.

3. An arrangement as claimed in claim 2, wherein said spiral lock clutch is situated in a groove in said connector shell.

4. An arrangement as claimed in claim 2, wherein said clutch includes a notch, and said spring ring includes a forwardly extending protrusion arranged to extend into said notch and thereby prevent relative rotation between said spring ring and said clutch.

5. An arrangement as claimed in claim 1, further comprising complementary engaging structures including a radially outwardly extending flange on the connector shell and a radially inwardly extending flange on the coupling nut, said radially inwardly extending flange on the coupling nut being captured between said spiral lock clutch and said radially outwardly extending flange on the connector shell.

6. An arrangement as claimed in claim 1, wherein said tooth ring includes radially outwardly extending tabs arranged to fit within a corresponding notch in the coupling nut to lock said tooth ring and coupling nut against mutual rotation.

7. An arrangement as claimed in claim 1, wherein said tooth ring includes radially outwardly extending knurls, said tooth ring being arranged to be press-fit into said coupling nut.

8. An arrangement as claimed in claim 1, wherein said shell is an electrical connector shell.

9. An arrangement as claimed in claim 8, wherein said shell is a Series III connector shell.

10. An arrangement as claimed in claim 1, wherein said retention member is a snap ring.

11. An electrical connector including a connector shell having a front mating end, a coupling nut fitted over the connector shell, and an anti-decoupling arrangement preventing rotation of the coupling nut in a decoupling direction, said anti-decoupling arrangement comprising:

a spiral lock clutch extending around said connector shell;

a spring ring positioned to the rear of the spiral lock clutch, front and rear being hereinafter taken relative to an axis of the connector shell and its front mating end, said spring ring also extending around said connector shell, said spring ring and spiral lock clutch being locked together against relative movement so that the spiral lock clutch rotates with the spring ring, and said spring ring further including beams extending obliquely in a rearwards direction;

a tooth ring positioned to the rear of the spring ring and also extending around said connector shell, said tooth ring being locked against angular movement relative to the coupling nut such that the tooth ring rotates together with the coupling nut, said tooth ring including a plurality of radial cuts that form teeth having first and second sides, said beams being pressed against first sides of said teeth during coupling and second sides of the teeth during decoupling; and a retention member positioned to the rear of the tooth ring in a second groove in the connector shell to capture the tooth ring, spring ring, spiral lock clutch, and coupling nut and retain them on the connector shell, wherein when said coupling nut is rotated in a coupling direction, a tooth wheel rotates in a coupling direction, said engagement of said beam with said teeth causes rotation of the spring ring in the coupling direction together with the rotation of the tooth wheel, which causes rotation of the spiral lock clutch in the coupling direction together with the spring ring, said spiral lock clutch being arranged to release a first groove and freely rotate relative to the connector shell to thereby provide minimal resistance to coupling, wherein when a torque less than a threshold value is applied to said coupling nut in a decoupling direction, a corresponding torque is applied to said tooth wheel in the decoupling direction, said engagement of the teeth with the beams further causing a torque to be applied to the spring ring in the decoupling direction, and said torque applied to the spring ring in the decoupling direction causing said spring lock clutch to lock and prevent rotation of the spring ring in the decoupling direction, and wherein when a torque greater than a threshold value is applied to the coupling nut in the decoupling direction, said greater torque causes said beams to ratchet over the teeth to permit the coupling nut to be rotated in the decoupling direction despite continued locking of the spiral lock clutch and spring ring against rotation.

12. An electrical connector as claimed in claim 11, wherein said spiral lock clutch is a wound radial spring band.

13. An electrical connector as claimed in claim 12, wherein said spiral lock clutch is situated in a groove in said connector shell.

14. An electrical connector as claimed in claim 12, wherein said clutch includes a notch, and said spring ring includes a forwardly extending protrusion arranged to extend into said notch and thereby prevent relative rotation between said spring ring and said clutch.

15. An electrical connector as claimed in claim 11, further comprising complementary engaging structures including a radially outwardly extending flange on the connector shell and a radially inwardly extending flange on the coupling nut, said radially inwardly extending flange on the coupling nut being captured between said spiral lock clutch and said radially outwardly extending flange on the connector shell.

16. An electrical connector as claimed in claim 11, wherein said tooth ring includes radially outwardly extending tabs arranged to fit within a corresponding notch in the coupling nut to lock said tooth ring and coupling nut against mutual rotation.

17. An electrical connector as claimed in claim 11, wherein said tooth ring includes radially outwardly extending knurls, said tooth ring being arranged to be press-fit into said coupling nut.

18. An electrical connector as claimed in claim 11, wherein said shell is an electrical connector shell.

19. An electrical connector as claimed in claim 18, wherein said shell is a Series III connector shell.

20. An electrical connector as claimed in claim 11, wherein said retention member is a snap ring.

21. An anti-decoupling arrangement arranged to be fitted on a connector shell having a front mating end and a coupling nut fitted over the connector shell, said anti-decoupling arrangement preventing rotation of the coupling nut in a decoupling direction, comprising:

a spiral lock clutch extending around said connector shell;

a spring ring also extending around said connector shell, said spring ring and spiral lock clutch being locked together against relative movement so that the spiral lock clutch rotates with the spring ring, and said spring ring further including beams extending obliquely towards a plurality of teeth extending axially from an inwardly extending flange in said coupling nut, said beams being pressed against first sides of said teeth during coupling and second sides of the teeth during decoupling; and a retention member positioned to the rear of the spiral clutch in a groove in the connector shell to capture the spring ring, spiral lock clutch, and coupling nut and retain them on the connector shell, wherein when said coupling nut is rotated in a coupling direction, said engagement of said beam with said teeth causes rotation of the spring ring in the coupling direction together with the rotation of the coupling nut, which causes rotation of the spiral lock clutch in the coupling direction together with the spring ring, said spiral lock clutch being arranged to release a first groove and freely rotate relative to the connector shell to thereby provide minimal resistance to coupling, wherein when a torque less than a threshold value is applied to said coupling nut in a decoupling direction, a corresponding torque is applied to said tooth wheel in the decoupling direction, said engagement of the teeth with the beams further causing a torque to be applied to the spring ring in the decoupling direction, and said torque applied to the spring ring in the decoupling direction causing said spring lock clutch to lock and prevent rotation of the spring ring in the decoupling direction, and wherein when a torque greater than a threshold value is applied to the coupling nut in the decoupling direction, said greater torque causes said beams to ratchet over the teeth to permit the coupling nut to be rotated in the decoupling direction despite continued locking of the spiral lock clutch and spring ring against rotation.

22. An arrangement as claimed in claim 21, wherein said spiral lock clutch is a wound radial spring band.

23. An arrangement as claimed in claim 22, wherein said spiral lock clutch is situated in a groove in said connector shell.

24. An arrangement as claimed in claim 22, wherein said clutch includes a notch, and said spring ring includes a forwardly extending protrusion arranged to extend into said notch and thereby prevent relative rotation between said spring ring and said clutch.

25. An arrangement as claimed in claim 21, wherein said first and complementary engaging structures include a radially outwardly extending flange on the connector shell and a radially inwardly extending flange on the coupling nut.

26. An arrangement as claimed in claim 21, wherein said shell is an electrical connector shell.

27. An arrangement as claimed in claim 26, wherein said shell is a Series III connector shell.

28. An arrangement as claimed in claim 21, wherein said retention member is a snap ring.

* * * * *

UNITED STATES PATENT AND TRADEMARK OFFICE

CERTIFICATE OF CORRECTION

PATENT NO. : 6,123,563
DATED : September 26, 2000
INVENTOR(S) : Johnson et al.

It is certified that error appears in the above-identified patent and that said Letters Patent is hereby corrected as shown below:

Title page,
Item [57], ABSTRACT,
Line 28, “coup ling” should read -- coupling --.

Column 1,
Line 44, “beam” should read -- beam, --.

Column 3,
Line 14, “include” should read -- includes --; and
Line 67, “mechanisms,” should read -- mechanisms. --.

Column 4,
Line 32, “antidecoupling” should read -- anti-decoupling --.

Column 7,
Line 28, “arrangementpreventing” should read -- arrangement preventing --; and
Lines 55 and 61, “a” should read -- said --.

Column 9,
Line 6, “a” (first occurrence) should read -- said --; and
Line 12, “a” should read -- said --.

Column 10,
Line 26, “a” should read -- said --.

Signed and Sealed this

Twenty-fourth Day of June, 2003

JAMES E. ROGAN
*Director of the United States Patent and Trademark Office*